US005301773A

United States Patent [19]

Jamieson et al.

[11] Patent Number: 5,301,773

[45] Date of Patent: Apr. 12, 1994

[54] POSITIVE TERMINAL OVERSPEED PROTECTION BY RAIL GRABBING

[75] Inventors: Eric K. Jamieson, Farmington; Young S. Yoo, Avon; Rudi Steger, West Hartford; Richard C. McCarthy, Simsbury, all of Conn.

[73] Assignee: Otis Elevator Company, Farmington, Conn.

[21] Appl. No.: 965,477

[22] Filed: Oct. 23, 1992

[51] Int. Cl.[5] ..... B66B 5/16

[52] U.S. Cl. ..... 187/88; 187/108; 188/189

[58] Field of Search ..... 187/38, 89, 90, 88, 187/108, 109, 100; 188/188, 189

[56] References Cited

U.S. PATENT DOCUMENTS

| | | | |
|---|---|---|---|
| 1,581,459 | 4/1926 | Lindquist | 187/90 |
| 1,738,215 | 12/1929 | Thurston et al. | 187/88 |
| 1,948,746 | 2/1934 | Dunlop | 187/89 |
| 3,441,107 | 4/1969 | Thorne et al. | 187/90 |

*Primary Examiner*—D. Glenn Dayoan
*Assistant Examiner*—Kenneth Noland
*Attorney, Agent, or Firm*—Breffni X. Baggot

[57] ABSTRACT

A permanent magnet 54 mounted on rods 41 passes vertically over a conductive plate 56 in an elevator hoistway 36, a reactive force causes movement of the permanent magnet 54 vertically away from the conductive plate 56 so that a wedge 24 secured to the rods 41 moves within a tapered wedge guide 44 until it contacts an elevator guide rail 14 on which an elevator car 2 is riding, thereby braking the elevator car 2.

4 Claims, 5 Drawing Sheets

POSITIVE TERMINAL OVERSPEED PROTECTION BY RAIL GRABBING

TECHNICAL FIELD

This invention relates to arresting movement of a high speed elevator car near either terminal (up, down) of an elevator hoistway.

BACKGROUND OF THE INVENTION

The problem addressed by the invention is how to provide terminal overspeed protection for a high speed elevator.

Elevators are presently provided with a plurality of bracing devices which are designed for use in normal operation of the elevator, as for example to hold the elevator car in place where it stops at a landing, and which are designed for use in emergency situations such as stopping the elevator car from plunging into the hoistway pit.

One bracing device for downward motion is by means of governor triggered safeties. A governor rope is looped over a governor sheave at the top of the hoistway and a tension sheave at the bottom of the hoistway and is attached to the elevator car. When the governor rope exceeds the rated speed of the elevator car by a limit, the governor grabs the governor rope, pulling up two rods connected to the elevator car, thereby pulling up two wedge safeties which pinch the guide rail on which the elevator car is riding. This braces the elevator car.

A second braking device for elevator downward motion is a buffer. Buffers are devices which are designed to stop a descending elevator car that moves downwardly beyond its normal limits of travel. Elevator pit buffers are commonly spring buffers or oil buffers, the former being typically used for elevator speeds of up to 200 feet/min. and the latter for speeds above 200 feet/min.

It becomes more difficult to decelerate the elevator car by means of a buffer as elevator speed increases; ultra high-speed elevators (above 1,800 feet/min.), which are highly desirable in high-rise buildings, require excessively long buffer pistons in order to provide adequate protection for passengers.

A reduced stroke buffer is shown in commonly owned U.S. Pat. application Ser. No. 07/914,822, "Pit Buffer Assembly for High-speed Elevators," filed on Jul. 19, 1992, which includes a crossbeam mounted on the elevator car guide rails by means of safety brakes which allow limited movement of the crossbeam when a downward force is exerted on it. The majority of the braking force for the descending elevator car is provided by the safety brakes on the buffer crossbeam.

For most high-speed elevator cars, oil buffers are used with a reduced stroke to give the elevator car an average retardation not exceeding 32.2 feet/sec.$^2$ when they are brought to rest after striking the buffer at 115% of the rated speed or a reduced speed if an emergency terminal speed limiting device is installed.

Even for the reduced stroke buffer, the minimum stroke required for an ultra high-speed elevator is 205 inches long, and a conventional oil buffer would require a total buffer length of approximately 40 feet.

The elevator codes usually allow reduced stroke buffers, but also require an emergency terminal stopping device which includes switches mounted on the elevator car in conjunction with governor overspeed contacts which turn off power to the motor driving the elevator car and apply the sheave brake when a cam contacts a vane. But if the emergency terminal stopping device (ETSD) fails, the elevator car could strike the buffer at the rated speed or faster and the desired average retardation of 32.2 feet/sec.$^2$ can be greatly exceeded.

The elevator brake devices described above are not operated in an instance where the elevator car is moving in the upward direction in the hoistway.

Commonly owned U.S. Pat. application Ser. No. 07/941,504, "Stopping of Elevators in the Up direction," filed Sep. 8, 1992, discloses a stopping plate provided in the overhead area in an elevator hoistway above the uppermost landing in the building. The stopping plate is mounted in the hoistway and is operable to stop upward movement of the elevator car without impacting the main components of the elevator car. There is provided a pair of inverted wedge safeties mounted on the stopping plate and guide rails. If the elevator car rises above the uppermost landing, the safeties will be set by the elevator car contacting the stopping plate, thereby limiting further upward motion of the elevator car.

It is desirable to have an elevator brake for arresting movement of the elevator car in the up direction and also desirable to arrest car movement in the down direction without a buffer.

Thus, the presently available solutions to the aforementioned problem involve long buffers or reduced stroke buffers in conjunction with long ETSD vanes.

DISCLOSURE OF THE INVENTION

Objects of the present invention include positive terminal overspeed protection for an elevator car at both terminals, which overspeed protection requires no power and no buffer.

According to the present invention, when a magnet mounted on an overspeeding elevator car, passes vertically over a conductive plate at a terminal in an elevator hoistway, eddy current induced in the plate cause a reaction force on the magnet causing the magnet to actuate a brake on the elevator car.

One advantage of the present invention is elimination of a buffer in a hoistway with no loss in safety. A second advantage is that the same assembly, the rods, on the elevator car activates wedges for braking an elevator car moving up or down.

BEST MODE FOR CARRYING OUT THE INVENTION

Figure 1:
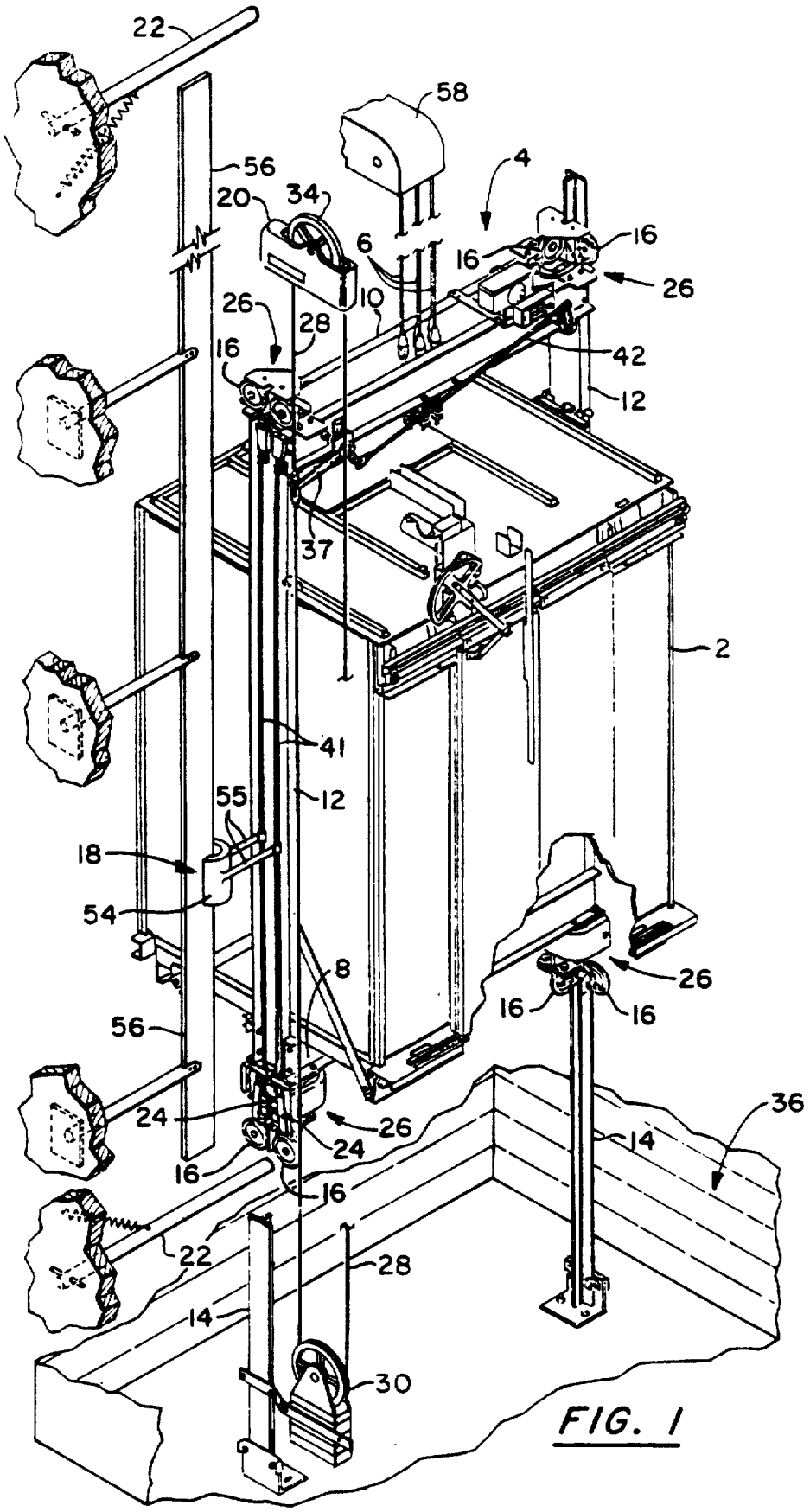
FIG. 1 is a perspective view of an elevator system employing the present invention.

FIG. 1 shows an elevator car 2 sitting in a car frame 4 which hangs from ropes 6. The car frame 4 includes a safety plank 8 on which the elevator car 2 sits, a crosshead 10, and two uprights 12, one on either side of the elevator car 2. On either side of the car frame 4 is a guide rail 14 on which the car frame 4 rides by means of roller guides 16.

An eddy current brake 18, a safety governor 20, and a spring-biased cam 22 each actuate two wedges 24 in a wedge safety 26 of FIG. 1 (shown in more detail in FIG. 2) to move vertically and pinch the guide rail 14, thereby braking the elevator car 2. A governor rope 28 passes around a tension sheave 30 at the bottom of a hoistway 36 and a governor sheave 34 at the top of the hoistway 36. The speed of the passing governor rope 28 is monitored by the safety governor 20. When the speed of the governor rope 28 exceeds the rated speed of the elevator car 2 by a limit, the safety governor 20 grabs the governor rope 28. Grabbing of the governor rope 28 rotates an outer safety operating lever 37 which causes rotation of an inner safety operating lever 38 disposed between beams 39 of the crosshead 10, then movement of the connecting rods 40 to cause vertical movement of rods 41. The purpose of the linkage 42 is to cause actuation of the rods 41 on both the left and right sides of the elevator car 2 simultaneously by virtue of an outer safety operating lever, an inner safety operating lever, connecting rods and rods, all of which are not shown for the right side of the elevator car but are similar to those for the left side of the elevator car. Vertical movement of either of two rods 41 actuates a corresponding wedge 24, at both the top and bottom ends of the rods 41. If the elevator car 2 is heading in the down direction at 115% of rated speed, the rods 41 will be pulled in the up direction. If the elevator car 2 is going 115% of rated speed in the up direction, counterweight safeties are tripped by a counterweight overspeed governor (not shown).

Figure 2:
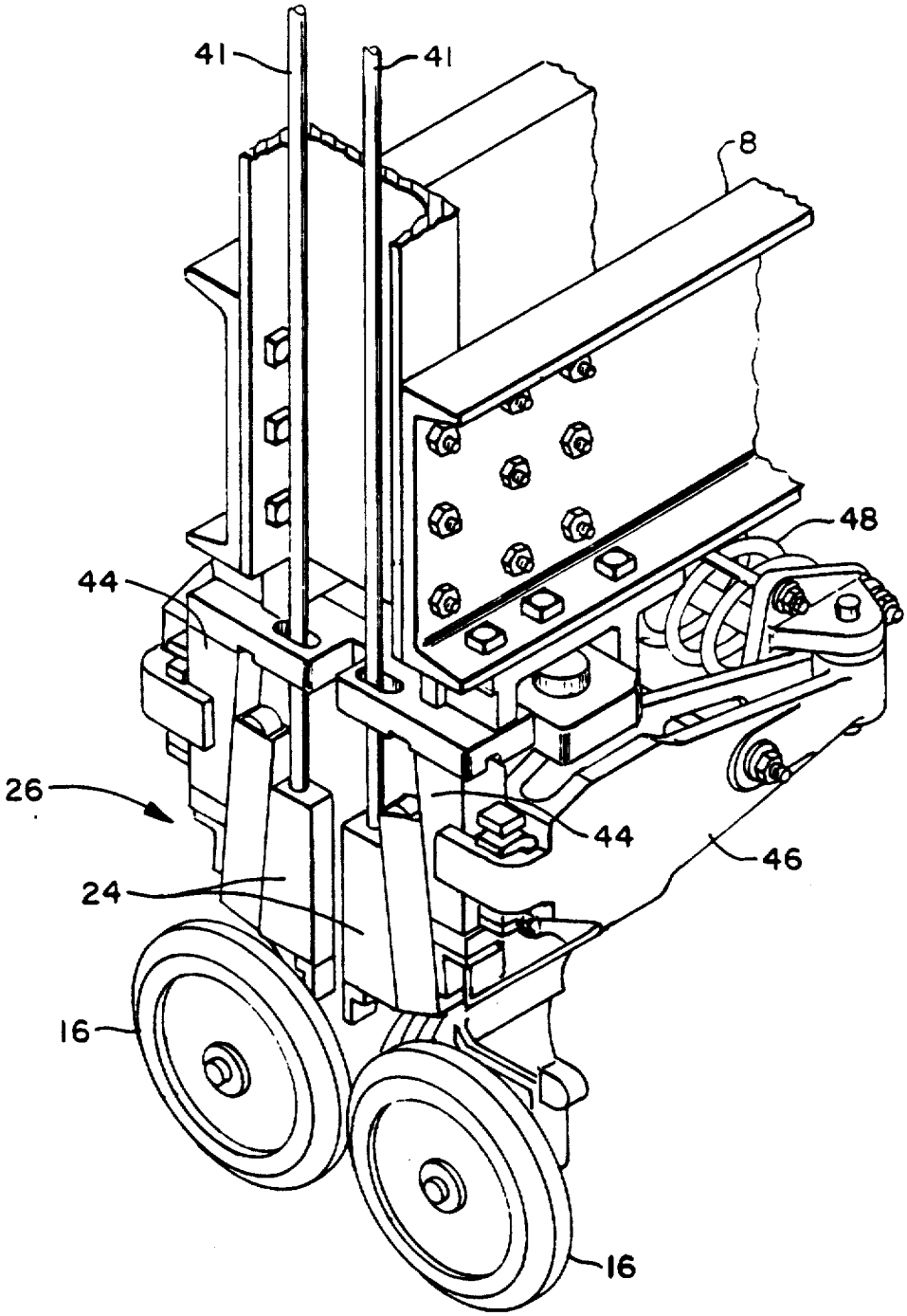
FIG. 2 is a magnified perspective view of a wedge safety shown in FIG. 1.
Figure 3:
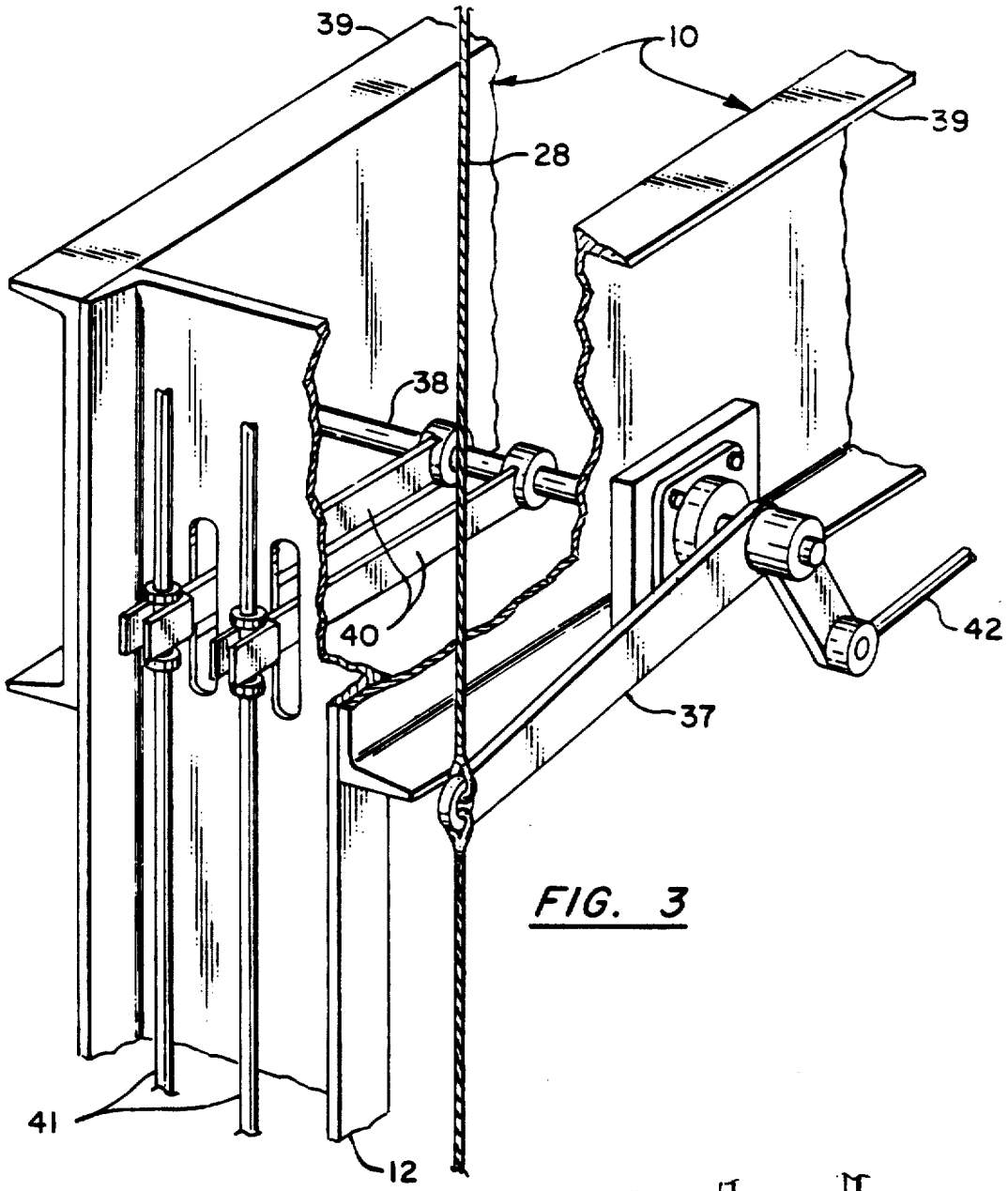
FIG. 3 is a perspective of rods connected to a safety-operating lever.

FIG. 2 shows the wedge safety 26 in detail. Each wedge 24 is secured to the rods 41 to sit within wedge guides 44 that are tapered such that if the safety governor 20 grabs the governor rope 28, then the rods 41 pull the wedges 24 vertically, deep into the wedge guides 44, so that the wedges 24 pinch the guide rail 14. The friction generated by the initial contact with the guide rail 14 produces an additional force, further urging the wedges 44 between the wedge guides 44 and guide rail 14, producing an increasing pinching force on the guide rail 14. The increasing pinching force on the guide rail 14 is limited when the wedges 24 push outwardly on pivot arms 46 against the force of a compression spring 48. The compression spring 48 controls the maximum pinching force to produce a progressive deceleration of the elevator car 2.

For a down direction run, the wedges 24 on the wedge safeties 26 below the elevator car 2 will be lifted so as to contact the guide rail 14 whereas the wedges 24 on the wedge safeties 26 above the elevator car 2 are lifted away from the guide rail 14. For an up direction run, the movement of the wedges 24 is reversed.

In FIG. 1 shows an eddy current brake 18. When a permanent magnet 54 connected to the rods 41 by magnet arms 55 moves over a conductive plate 56 in the hoistway 36, a reaction force is generated to prevent the permanent magnet 54, and the rods 41 connected to it, from passing over the conductive plate 56. Thus, if the elevator car 2 is moving in the down direction, the reactive force acts in the up direction. If the elevator car 2 is moving in the up direction, the reactive force acts in the down direction. When the reactive force acts on the rods 41 via the permanent magnet 54, the rods 41 move vertically, initiating contact between the wedges 24 and guide rail 14, thereby causing the elevator car 2 to be braked. The braking action is effective whether the rods 41 are moved up or down, the same as during operation of the safety governor 20.

Figure 4:
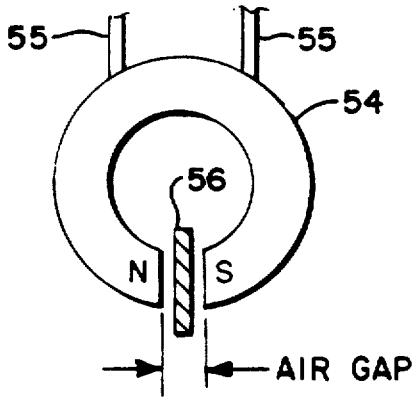
FIG. 4 is a top sectional view of a conductive plate in an air gap of a permanent magnet.

FIG. 4 shows a top view of the permanent magnet 54 shown partially in FIG. 1.

Should the elevator car be traveling too slowly to cause braking by means of the governor 20 or eddy current brake 18, one of the spring-biased cams 22, at the bottom of the hoistway 36 or at the top of the hoistway 36, activates movement of the wedges 24 when a magnet arm 55 contacts it. Similar to the case of the safety governor 20 and eddy current brake 18, the rods 41 are caused to move vertically, bringing the wedges 24 into contact with the guide rails 14 for braking the elevator car 2.

Since the eddy current brake 18 and safety governor 20 do not require electric power, positive stopping can be provided at all times. The eddy current brake 18 and cam 22 do not affect the function of the safety governor 20 to actuate the wedges 24 when the elevator car 2 is exceeding the rated speed.

The vane length is chosen to allow a deceleration at 115% rated speed provided by the wedge safety, typically 1 g, but actually depends on the safety design. The conductive plates 56 are placed so that the braking action occurs prior to the elevator car 2 reaching the terminal; the conductive plates 56 extend vertically from the terminals toward the middle of the hoistway 36. The benefit over a buffer is braking action before the elevator car 2 reaches a terminal rather than after, as with a buffer.

Figure 5:
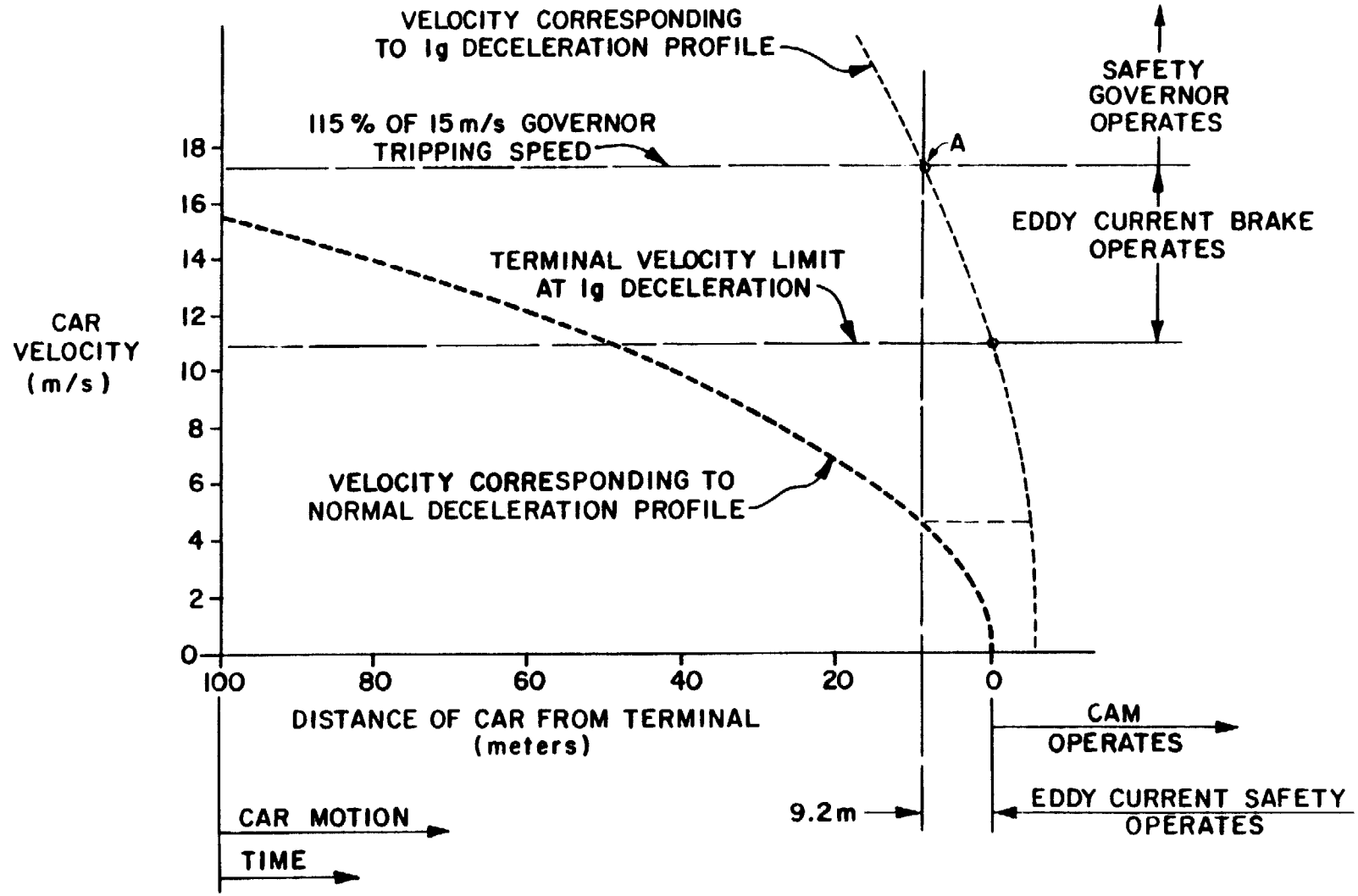
FIG. 5 is a graph of elevator car velocity versus distance from an elevator terminal for an elevator car moving at 15 meters/sec.

FIG. 5 is a graph the velocity of of elevator car 2 versus distance from an elevator terminal, where the elevator car 2 rated velocity is 15 meters/sec. When the elevator car 2 is moving towards the terminal faster than the governor tripping speed, the wedge safeties 26 are tripped by the governor 20. The intersection of the governor tripping speed with a 1 g deceleration profile of an elevator car 2 making a safety stop defines the eddy current brake actuation range-from the terminal out to approximately 9.2 meters at point A. The eddy current brake 18 works when the elevator car 2 is moving slower than the governor tripping speed, but faster than a given terminal velocity limit, here 11 meters/sec. Below this speed limit, the reactive force is insufficient to actuate the wedges 24 via the magnet-rod assembly and therefore the wedges 24 are not actuated on a normal-speed run into a terminal and the elevator car 2 is stopped by normal braking of a sheave 58 in a known manner. The spring-biased cam 22 moves the rods 41 to actuate the wedges 24 when the magnet arm 55 contacts the cam 22, if the eddy current brake 18 or safety governor 20 have not, when the elevator car 2 moves beyond the terminal at a speed below the terminal velocity limit.

The deceleration profile of an elevator car 2 under normal conditions is shown for reference, to avoid nuisance braking when the elevator is not overspeeding. If the elevator car 2 is moving toward the terminal along this profile, it will be moving too slowly to cause braking of the elevator car 2 by the eddy current brake 18 or the safety governor 20 and only the cam 22 may cause the wedges 24 to be actuated.

Figure 6:
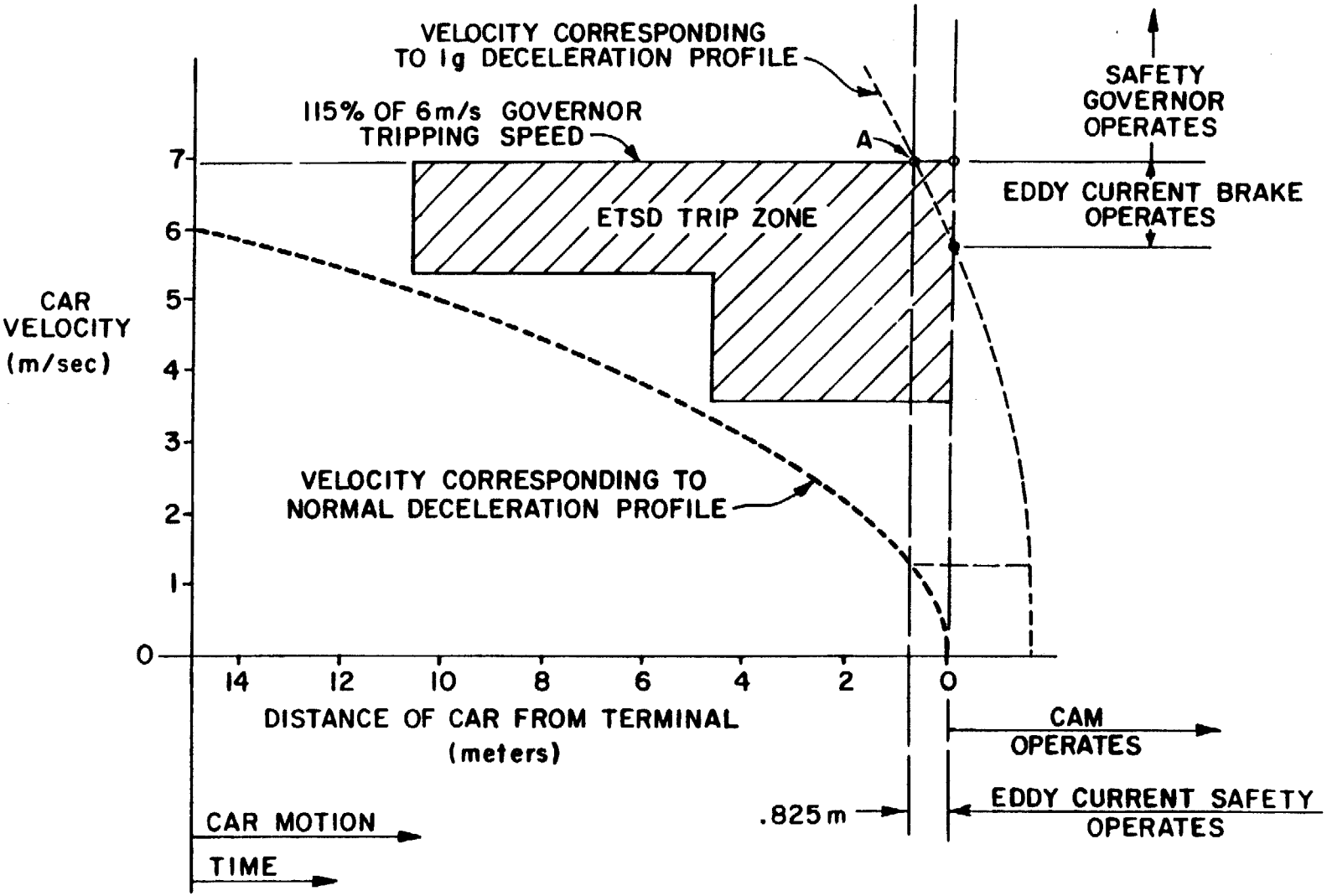
FIG. 6 is a graph of elevator car velocity versus distance from an elevator terminal for an elevator car moving at 6 meters/sec.

FIG. 6 shows elevator car velocity vs. distance from a terminal for elevator car 2 moving at 6 meters/sec. The emergency terminal stopping device (ETSD) trip zone mentioned in the background of the invention is superimposed to show the benefit of the present invention. Prior art shows a reduced stroke buffer functioning in conjunction with an ETSD to brake elevator car 2. The vane for an ETSD is 10 meters long where the elevator car speed is 6 meters/sec. The present invention, by contrast, does away with a buffer altogether and uses a cam 22 and a conductive plate 56 of length equal to 0.825 m. Similar benefits in the present invention over the prior art are seen where the rated speed is 15 meters/sec. There, the conductive plate 56 is 9.2 meters long, providing a simpler and less expensive brake rather than a buffer and an ETSD with a vane 60 meters long.

It should be understood by those skilled in the art that various changes, omissions, and additions may be made herein without departing from the spirit and scope of the invention.

We claim:

1. A rail grabbing apparatus for exerting a braking force on an elevator guide rail to brake the movement of an elevator car near an elevator terminal, comprising:

(a) a first wedge for contacting said elevator guide rail and producing a braking action;

(b) a second wedge on a side of said elevator guide rail opposite said first wedge;

(c) two rods, one connected to each wedge such that vertical movement of said rods initiates contact between said first and second wedges and said elevator guide rail; and (d) brace force means including a magnet and a conductive plate and disposed at least along a limited length of one elevator terminal for causing said rods to initiate contact between said first and second wedges and said elevator guide rail, said magnet being mounted on at least one of said rods, for inducing a current in said conductive plate in a direction so as to generate a magnetic field to oppose the changing field that induced the current so that said magnet causes said rods to move, causing said first and second wedges to contact said elevator guide rail and exert the bracing force on the elevator guide rail.

2. The rail grabbing apparatus of claim 1, further including a safety governor, for causing said rods to initiate contact between said first and second wedges and said elevator guide rail.

3. A device for exerting a braking force on an elevator guide rail to brake the movement of an elevator car near a terminal of an elevator hoistway, comprising:

(a) at least one safety for contacting said elevator guide rail and producing said braking action;

(b) a magnet disposed on said elevator car; and (c) a conductive vane disposed vertically along a limited length of said at least one terminal hoistway such that as said magnet moves along said conductive vane a current is induced in said conductive vane in a direction so as to generate a magnetic field to oppose a changing field that induced said current so that said magnet causes said safety to contact said elevator guide rail and exert said braking force on said elevator guide rail, wherein the device may exert said braking force near a terminal of said hoistway.

4. A method for braking an elevator car at a terminal of an elevator hoistway, which comprises the steps of:

(a) providing a magnet disposed on said elevator car;

(b) providing a conductive vane disposed vertically along a limited length of said hoistway near a terminal;

(c) moving said magnet over said conductive vane for producing an electromagnetic reaction force;

(d) providing a braking force in response to said electromagnetic reaction force for braking said elevator car near said terminal.

* * * * *